United States Patent [19]

Alonso et al.

[11] 4,345,500

[45] Aug. 24, 1982

[54] HIGH RESOLUTION MUSICAL NOTE OSCILLATOR AND INSTRUMENT THAT INCLUDES THE NOTE OSCILLATOR

[75] Inventors: Sydney A. Alonso, Strafford; Cameron W. Jones, Wilder, both of Vt.

[73] Assignee: New England Digital Corp., White River Junction, Vt.

[21] Appl. No.: 144,525

[22] Filed: Apr. 28, 1980

[51] Int. Cl.³ ..... G10H 5/06

[52] U.S. Cl. ..... 84/1.01; 84/DIG. 11; 307/225 R; 328/15; 328/16; 364/702; 364/703; 364/768

[58] Field of Search ..... 84/1.01, 1.03, 1.22, 84/DIG. 11; 364/702, 703, 719, 720, 768; 307/220 R, 225 R; 328/14–18

[56] References Cited

U.S. PATENT DOCUMENTS

| | | | |
|---|---|---|---|
| 3,515,792 | 6/1970 | Deutsch | 84/1.03 |
| 3,748,440 | 7/1973 | Alexander | 364/702 X |
| 3,809,786 | 5/1974 | Deutsch | 84/1.01 |
| 3,842,702 | 10/1974 | Tsundoo | 84/1.01 |
| 3,888,153 | 6/1975 | Deutsch | 84/1.01 |
| 3,908,504 | 9/1975 | Deutsch | 84/1.22 X |
| 3,929,053 | 12/1975 | Deutsch . | |
| 3,951,030 | 4/1976 | Deutsch . | |
| 3,952,623 | 4/1976 | Deutsch . | |
| 4,009,449 | 2/1977 | Agans . | |
| 4,085,644 | 4/1978 | Deutsch et al. | 84/1.01 |
| 4,085,645 | 4/1978 | Ryon | 84/1.01 |
| 4,103,581 | 8/1978 | Deutsch . | |
| 4,108,035 | 8/1978 | Alonso | 84/1.01 |
| 4,115,863 | 9/1978 | Brown | 364/719 X |
| 4,175,464 | 11/1979 | Deutsch . | |
| 4,178,822 | 12/1979 | Alonso | 84/1.01 |
| 4,215,616 | 8/1980 | Gross | 84/1.01 |
| 4,279,185 | 7/1981 | Alonso | 84/1.01 |

OTHER PUBLICATIONS

"The Fairlight Computer Musical Instrument," *Computer Music Journal*, vol. 3, No. 4, Dec. 1979.

*Primary Examiner*—Stanley J. Witkowski
*Attorney, Agent, or Firm*—Robert Shaw

[57] ABSTRACT

A musical note oscillator producing notes at musical intervals having high resolution and high frequency stability achieved with an economy of components and control signals. The oscillator may be operated to provide multiple notes simultaneously and independently; and it is described in the context of a musical instrument.

22 Claims, 14 Drawing Figures

KEY SELECTOR SIGNAL TIMING

OSCILLATOR OPERATION

MULTIPLEX OSCILLATOR
TIMING

CLOCK LOGIC TIMING 25B
25A
$25B_2$
$25B_1$
$25A_2$
$25A_1$
64D
64C
64B
64A
64
97C
97B
97A
63
79D
79C
79B
79
80C
80B
80A
80
81C
81B
81A
87C
87B
109
107B
107A
107C
76C
76B
76A
84C
84B
84A
125
123
121
91
LS
103
90
801
27
NOTE OSCILLATOR 60N
60M
60P
60
127
129
18

HIGH RESOLUTION MUSICAL NOTE OSCILLATOR AND INSTRUMENT THAT INCLUDES THE NOTE OSCILLATOR

The present invention relates to digital electronic musical note oscillators and to instruments embodying the digital electronic musical note oscillators.

Heretofore, digital electronic musical note oscillators used in musical instruments have been restricted as to the number of different notes available within a given octave by the complexity of the hardware or of the control signals, by the speed required to stabilize the hardware, or by the occurrence of unwanted artifacts, in particular frequency instability.

Digital electronic instruments are called upon to produce tones of varying complexity with fundamental frequencies of 20 hertz or less to greater than 5,000 hertz. The complex tones have related frequencies, or harmonics, extending into the upper limit of audible sound, about 20,000 hertz.

Accordingly, tones may be generated by two basic approaches. First a signal is generated which is rich in harmonics, followed by selective filtering to produce the desired tone. A second, more versatile technique is to generate a digital signal at a multiple of the fundamental of the desired note frequency. This fundamental multiple is used to index a stored representative waveshape of the desired tone, where the amplitude is specified at specific uniform increments through the sample tone waveshape; there are as many increments, and therefore amplitude samples, as the value of the multiple of the fundamental frequency. For a more detailed explanation, see the description in the musical note oscillator disclosed in U.S. Pat. No. 4,108,035 (Alonso, one of the present inventors), the wave reproducer shown in the Deutch Pat. No. 3,515,792 (June 2, 1970) and the electronic music sampling technique in the United States Pat. No. 4,279,185 of Alonso, one of the present inventors.

The second of the above mentioned techniques of tone generation is best for present purposes. By that technique there may be typically 20 to 2,000 or more samples, or increments, of the representative waveshape in order to create the desired tone of the notes. The frequency needed to sample the waveshape will then be 20 to 2,000 times the fundamental frequency, which is ultimately restricted by the capabilities of the electronic portion of the instrument, more specifically, the electronic oscillator. This operation of the waveshape sampling is explained by the Nyquist sampling theorem; see said U.S. Pat. No. 4,279,185 for further details.

For reasons of stability and repeatability, digital oscillators generally include a source of constant frequency, called a clock, which is typically crystal controlled, followed by a divider capable of dividing the clock frequency by a selectable integer; however, the most commonly used musical scale, the even-tempered scale, has notes at a musical interval of $\sqrt[12]{2}$, or approximately 1:1.059, a number difficult to achieve by simple integer division. It can be done by raising the clock frequency high enough to permit division by large integers so that each of the intervals is accurately reproduced. As a general matter, the narrower the desired interval between the notes, the higher the clock frequency must be; as a musical change in intervals approaches a continuous glissando type change, the clock frequency exceeds the maximum usable by the digital electronics.

The prior U.S. Pat. No. 4,108,035 (Alonso) achieved somewhat higher resolution at no significant increase in clock frequency. The prior art Alonso patent achieved the practical effect of determining the oscillator frequency $$\text{oscillator frequency} = \text{clock frequency} \times M/N \quad (1)$$

where M is an intefer number valued 0–15 and N is an integer valued 1–256, such that the clock is multiplied by a fraction between 1/256 to 1/16.

To achieve greater frequency selection according to prior art, the value of M is increased above 16 to 256, to the maximum value of N. The frequency produced has an average interval as predicted by expression (1); however, as the occurrence of M/N fractions become close to 1, significant time period jitter may occur, which produces noticeably degraded musical tones.

The difference between a constant long term average frequency and a short term frequency jitter is seen in the fundamental operation of the prior art shown in the U.S. Pat. No. 4,108,035. As the increment steps are increased in size, relative to the range over which the adder will be incremented, the likelihood of a remainder upon an adder overflow increases. The remainder, also added to the range on the onset of the next cycle, is the source of the jitter. Until the remainder plus increment equals the range, the period, or the number of increment steps between adder overflow, will remain constant. When the remainder plus an integer number of increments equals the range, the number of steps of incrementing is reduced by one; hence, a different period occurs, which in view of prior periods, is jitter. For most clock frequencies having a small increment with respect to the range, or $M/N < 1/16$, the spacings and consecutive grouping of differing overflow periods are more likely to be infrequent with respect to the average frequency produced, and the harmonic components of the jitter are less noticeable. Under conditions having an increment larger with respect to the range, or $1/16 < M/N \leqq 1$, the period, or number of increment steps between the adder overflow, may be significantly reduced; for instance when $N=5$ and $M=3$, the oscillator will have two groups of carry-out pulses with two clock period intervals and one group with one clock period interval, representing a fifty percent change in period, which causes a degraded musical tone to be generated.

Accordingly, it is an object of the present invention to provide a musical note oscillator that achieves a high resolution of frequency intervals and low frequency jitter, but nevertheless achieves economical use of hardware.

A further object is to provide an oscillator that generates musical tones in a manner where much of the equipment duplication in tone selection, generation and reproduction of a plurality of musical tones is eliminated.

An additional object is to provide oscillator means and methods to accept a plurality of signals simultaneously from the player of an instrument, from prerecorded player instructions, and from other predetermined control devices.

Another object is to provide means of controlling an oscillator such that the change of all control parameters occurs simultaneously.

A still further object is to provide an oscillator which produces a plurality of different frequencies simultaneously within the same oscillator components without impairment of the above oscillator fulfilling the foregoing objects.

Another object is to provide a musical instrument embodying the above oscillator.

These and still further objects are addressed hereinafter.

The foregoing objects are achieved in an oscillator which produces a frequency stable note in a musical scale having a narrow and predetermined frequency interval. The oscillator includes arithmetic means, which is cyclically incremented over a fixed modulus. A carry pulse is produced by the arithmetic means when the modulus is exceeded. The period between carry pulses is predetermined according to the value of the modulus and the increment. The values of the increment selected are resolved at least one-half of the integer step of the modulus value. There is shown a musical instrument including such a musical note oscillator.

The invention is hereinafter described with reference to the accompanying drawing in which.

Figure 1:
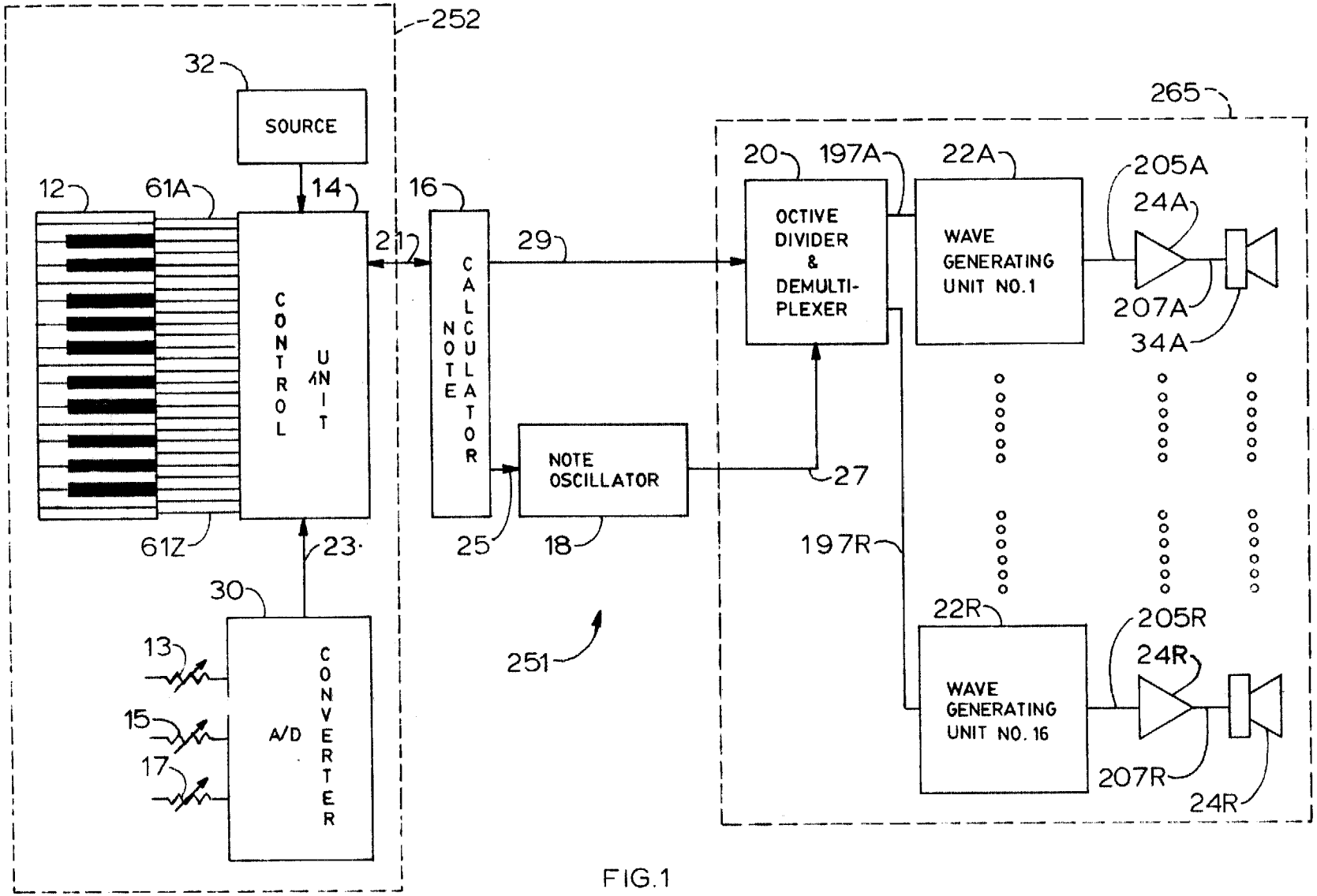
FIG. 1 is a block diagram of an electronic musical instrument and includes a key selector, a note control selector, a control unit, a note calculator, a note oscillator, and a wave generating system.

In the explanation that now follows, the invention is discussed first in general terms; later more specific structures are taken up. Turning now to FIG. 1, there is shown at 251 a digital electronic musical instrument that is shown in the embodiment as a keyboard instrument in which a desired note is selected by depressing a key on a keyboard 12, comprising keys 12A, 12B . . . Each key of the keyboard 12 is hard-wired to control unit 14 wherein the note selected is converted to a binary number. The plurality of keys selected by an operator or player are serially multiplexed by a key selector 40 having a serial output 203A in FIG. 2. A representation of that serial output is shown in FIG. 3. The keys 12A-12Z in FIG. 2 correspond to a signal $212A_1$–$212Z_1$ for the time cycle labeled 211 and corresponding to signal $212A_2$–$212Z_2$ in time cycle 213, and so forth, as shown in FIG. 3. The signals represented are binary and have only two states, as shown in the drawing. The short signals appearing on the lead 203A are further selected by a note control selector 42 (FIG. 2) which in turn provides an output signal along lead 21A. The control unit 14, as later discussed, can accept either analog or binary digital signals as input and provide an output at 21 that is binary. (In FIG. 1, the output 21 is shown as a single conductor but it is later shown in FIG. 2 as multiple outputs. To indicate correspondence between figures, the conductors in FIG. 2, for example, are labeled 21A, 21B and 21C. A similar approach is used to indicate correspondence between other circuit elements). The output 21 is processed by a note calculator 16 to provide at 25 a note signal comprising a fractional increment number (called Io herein) and, a Do number, the note signal being connected as input to a note oscillator 18. The note oscillator is now discussed in some detail with reference to FIG. 4 and in greater detail later with reference to FIGS. 7A and 7B.

Figure 4:
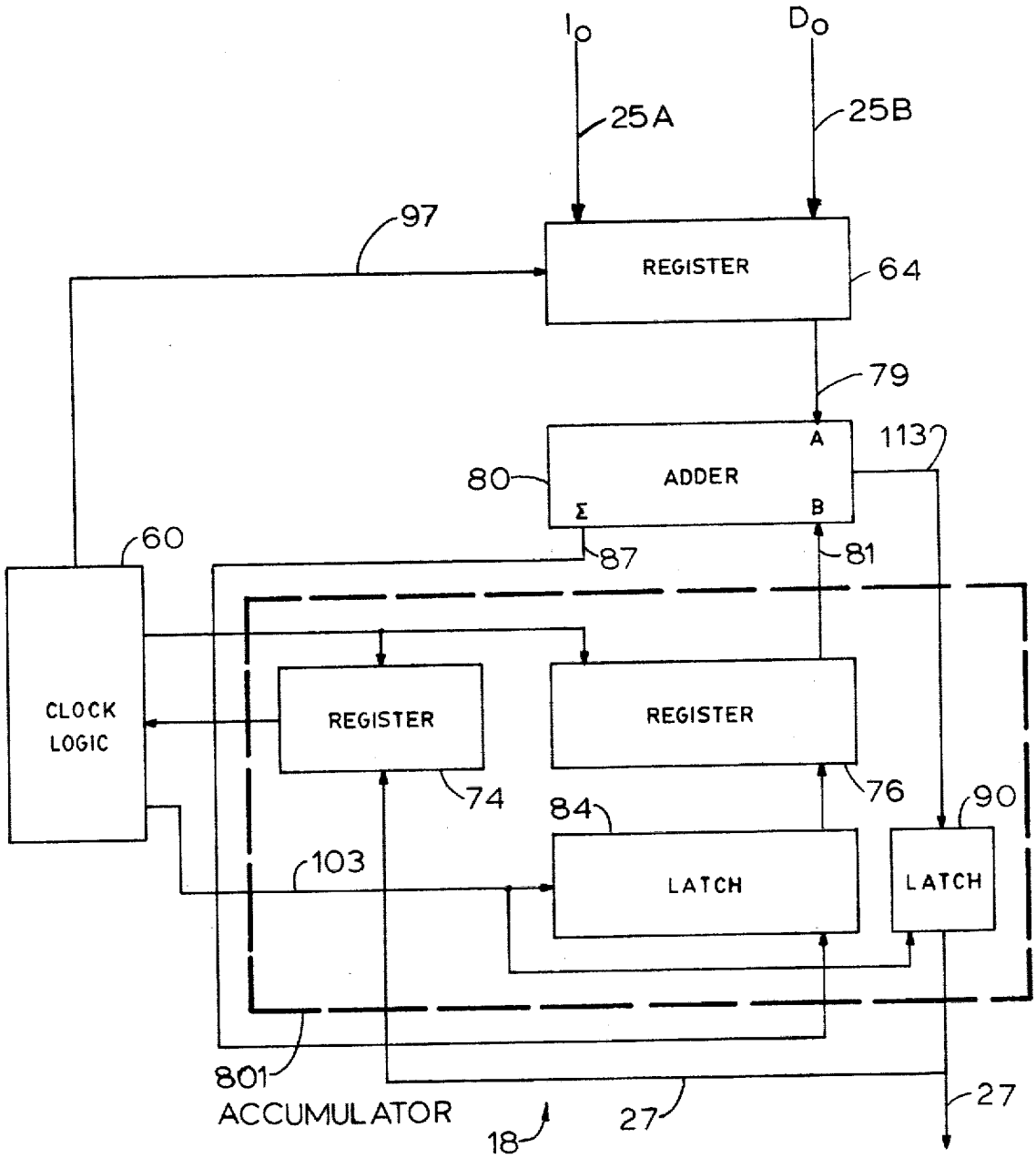
FIG. 4 is a block diagram of one form of the note oscillator according to FIG. 1, including an accumulator, clock logic, a register, and an adder.

The oscillator 18 in FIG. 4 includes clock logic 60 for generating clock pulses at a predetermined periodic repetition rate, an adder 80, having a first adder input B to receive first input signals along a multi-lead conductor 81 from the outputs of a register 76 and a second adder input A to receive a fractional input number along a multi-lead conductor 79. The adder has a modulus, that is, a maximum count above which a carry signal is generated. The adder 80 has an adder sum output 87 and a carry-out output 113. The adder 80 is operable to perform an addition between the first input signal at B and the fractional increment number at A and to provide a carry-out pulse at the carry-out output 113 whenever the modulus is exceeded. The first adder input at 81 (i.e., the input B in FIG. 4), as later discussed, includes a least significant bit and the second adder input at 79 (i.e. the input A in FIG. 4) includes a least significant bit; the bits of the second adder input A are aligned within the adder 80 to be less significant than the bits of the first adder input B. The note oscillator 18 also includes a register 74, a latch 84, and a latch 90 which act, in combination with the register 76, substantially as an accumulator 801. The accumulator 801 is connected to the clock logic 60 to receive clock pulses as well the adder sum on multi-lead conductor 87; the accumulator 801 is operable to store the adder sum and to provide the stored adder sum at the accumulator output 81 which is connected to the first adder input B of the adder 80 so that an oscillator output at 27 is provided by periodic carry-out pulses at the carry-out 113, but preferably through the latch 90 in the accumulator 801, as shown. The periodic carry-out pulses at 27 have a rate proportional to the fractional increment number received by the second adder input A on the multi-lead conductor 79; the pulses at 27 are also fed back to the clock logic 60 to provide enable pulses which determine, as alternate conditions, whether the register 64 provides at 79 a fractional increment number (Io) or a Do number. The Io and Do inputs to the register 64 are at 25A and 25B, respectively.

It is appropriate at this juncture to discuss briefly a most important aspect of the oscillator 18. As noted above and in greater detail later, the oscillator output at 27 is determined by the fraction of increment number (Io) and the divisor number (Do - Io); these have typically (in order devices) has the same numerical significance. In the oscillator 18, however, the significance of the Io is offset in the manner noted herein to render it less numerically significant than the Do in order that some of the bits of the Io have fractional significance compared to the Do. In this way the oscillator 18 achieves a greater variety of useable frequencies without any significant increase in the necessary hardware.

One further matter should be addressed here. The player control signals mentioned above arise from the keyboard 12, but those signals may be provided by analog inputs 13, 15, and 17, that are shown as variable resistors and may be, for example, a knob-control 13, a pedal-control 15, and a ribbon-control 17. Also, taped inputs at 32 may be provided as alternatives to or in conjunction with the keyboard inputs.

Returning again to FIG. 1, the digital note calculator 16 is responsive to note information on the conductor 21 from the control unit 14. The digital calculator 16 calculates the value of the fractional increment number (Io) on the basis of the control signal at 21 to assure that the carry-out pulses at 27 occur at a repetition rate proportional to the fundamental frequency of the desired note. The desired note is actually produced by a note generator 265 that receives the carry-out pulses on the conductor 27 and the octave number from the note calculator 16 on the conductor 29.

Figure 2:
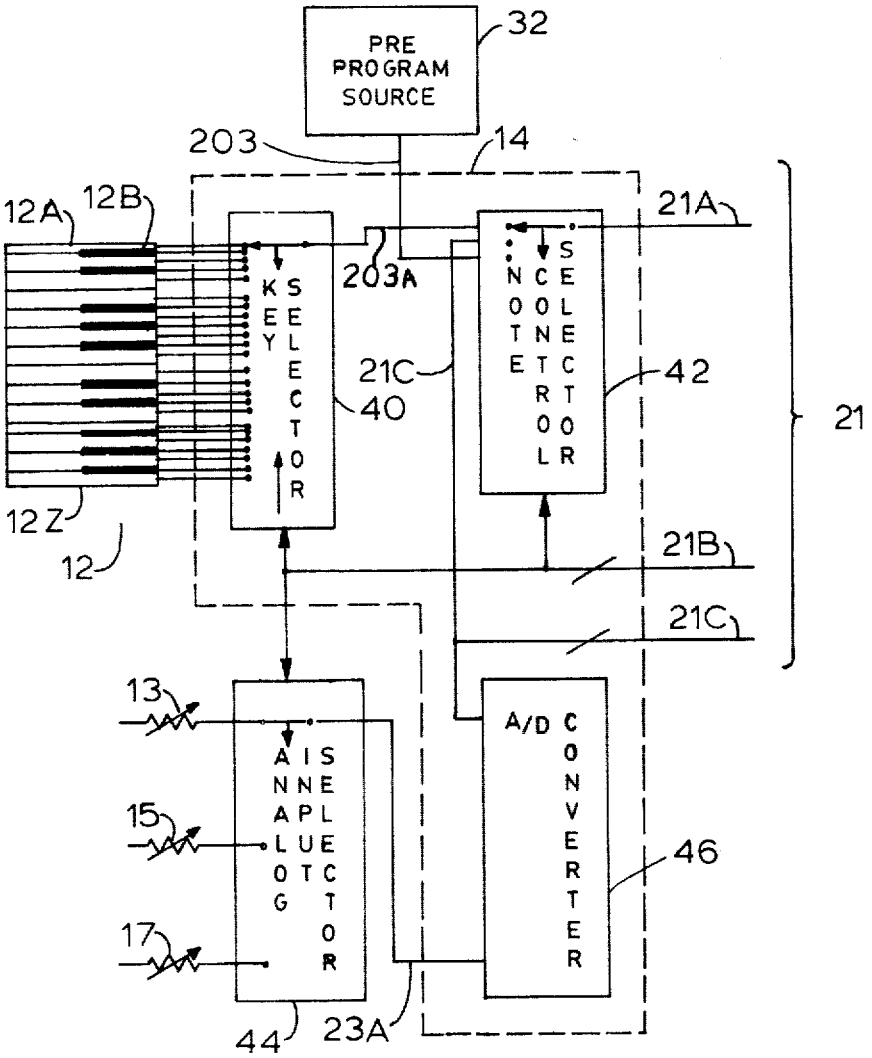
FIG. 2 is a block diagram on one form of the key selector and control unit of FIG. 1.
Figure 3:
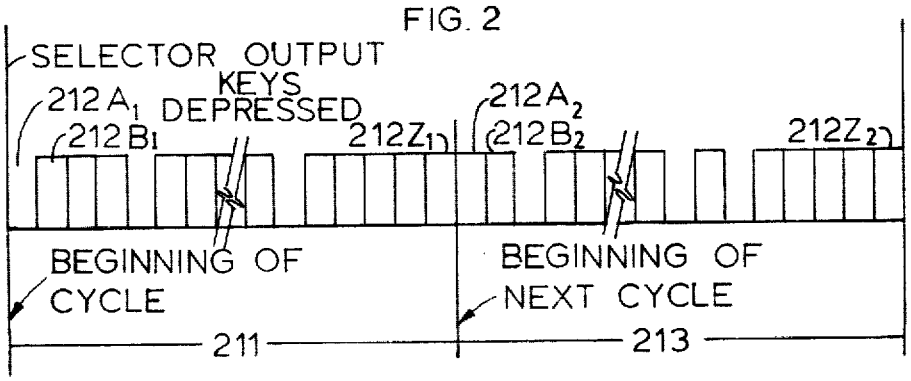
FIG. 3 is a timing diagram for one form of the key selector of FIG. 2.

The control unit 14, as shown in FIG. 2, is mostly a switching arrangement wherein a specific signal from one or more of the player control elements 12, 13, 15 and 17 is selected by timing and control signals on leads 21B (the slash mark plus the number indicate a multi-lead conductor to be placed on leads 21B connected to the note calculator 16. The timing and control signal on leads 21B may switch the various incoming signals sequentially so that a single controller 14 and subsequent note calculator 16 will suffice for all player signals. In the case of a analog-to-digital converter 46 in FIG. 2, digital signals appear on data lines 21C to note control selector 42 of the control unit 14. The note control selector 42 receives signals from preprogrammed source 32 on multi-conductor lead 203, key selector 40 signal output on lead 203A, and A/D converter 46 on lead 21C, to provide a selected output signal on lead 21A according to selector control signal on multi conductor lead 21B. A key on the keyboard 12 would be pressed to signify which note is to be defined, and the knob-controlled resistor 13 would be adjusted until the desired note frequency was selected. In this manner, it is possible to define any key scale at the desire of the player.

For rapid change or resetting of the musical instrument note signals in the control unit 14, and even to provide a pre-recorded selection of tone sequences (e.g., a song), the larger memory unit 32 in FIG. 1 (perhaps having interchangeable contents, such as a tape or magnetic disc) can be connected to the musical instrument through the control unit 14.

The minimal signals generated by the note calculator 16 are the Io, Do, and the octave number described below. Additionally, the control unit 14 may provide other signals for specific notes. The output of the control unit 14 may be either a single connection for each of the signals provided or it may be sequentially placed on common output lines. All Io signals, for example, may be placed on parallel Io lines at a uniform time interval, to be retrieved by the oscillator 18 in the same successive sequence. Thus, a significant savings in interconnections and hardware switching may be realized.

Turning now to FIG. 4, the oscillator 18 described above, is now dealt with in greater depth. The frequency produced by the oscillator 18 has the general relationship:

$$\text{Osc. output freq.} = \text{Clock Freq.} \times \text{Increment/Divisor} \quad (2)$$

where a sum produced by the adder 80 is incremented by a determined increment provided by the register 64 periodically under the control of the clock logic 60. The sum is limited to the maximum allowed by the adder 80; when this maximum is exceeded, a carry pulse is produced at 113 and temporarily stored by the latch 90 before leaving the oscillator 18 by the lead 27 as the oscillator output signal. (It will be noted that the signals on the conductors 113 and 27 are identical, but the latch 90 permits the output at 27 to differ in time from the signal on the conductor 113.)

Figure 5:
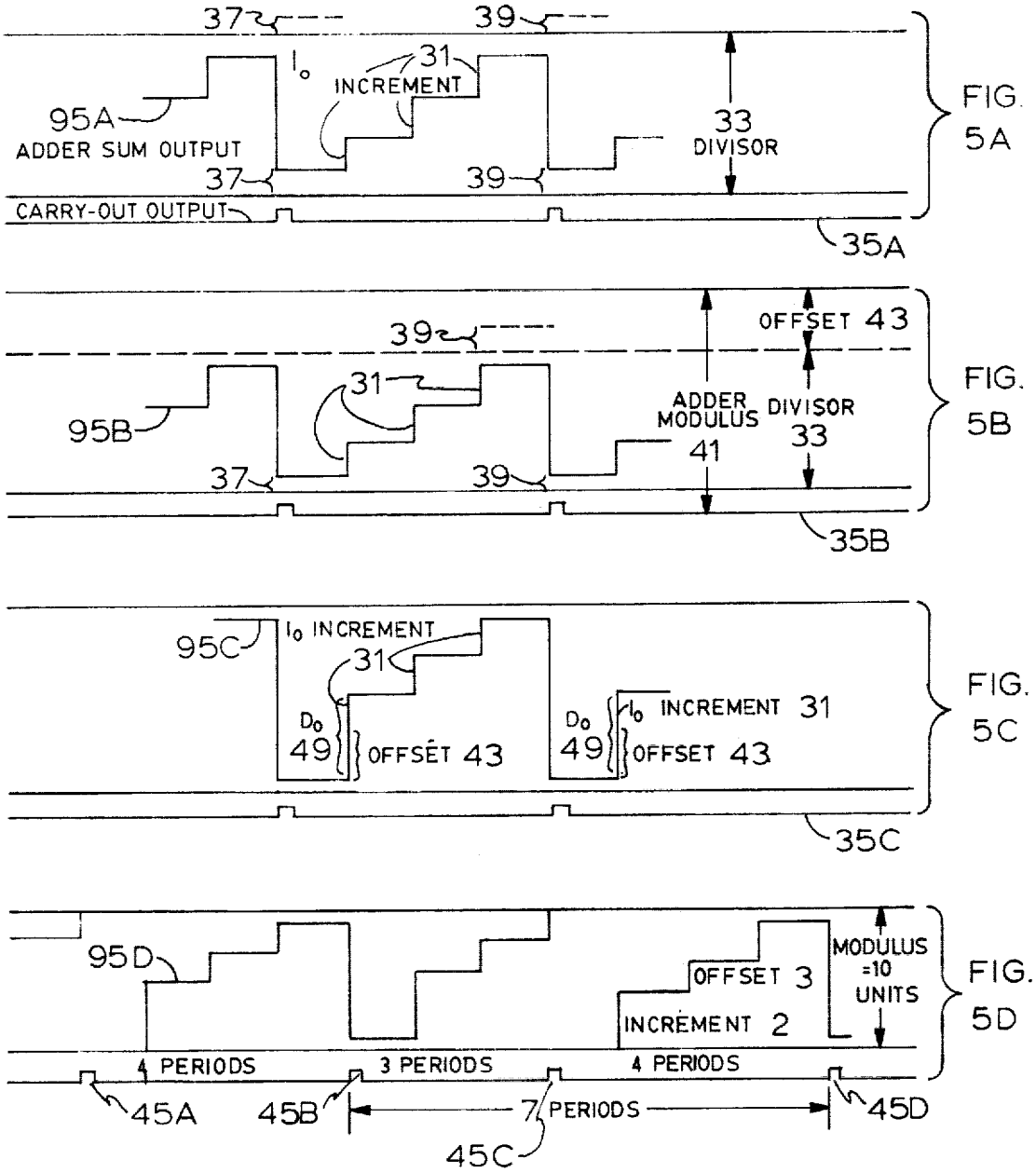
FIG. 5A is a graph of the adder outputs of a simplified form of FIG. 4.
FIG. 5B is a graph of the adder outputs of a form of FIG. 4 in view of hardware constraints.
FIG. 5C is a graph of the adder outputs of a form of FIG. 4 incorporating corrective measures in view of the hardware constraints.
FIG. 5D is a graph of the adder outputs of a form of FIG. 4 showing period variations on one of the outputs.

Each of the graphs in FIGS. 5A–5D represents the signal levels of the output signals from the adder 80. More specifically, signals 95A–95D represent the levels of the signals at the output 87 and signals 35A–35D represent levels of the signals at the output 113 in FIG. 4. The intent here is to obtain a carry-out signal 35A whenever the modulus (labeled 33 in FIG. 5A) of the adder 80 is exceeded. In practice one wants to change the modulus, depending upon the musical note to be reproduced; however, in general, the adders used in an instrument, like the instrument 251, have fixed-modulus (e.g.,$2^{12}$) hardware. The "fixed" aspect of the hardware is represented by the magnitude labeled 41 in the graph of FIG. 5B. Taking the two graphs of FIGS. 5A and 5B together, the end sought is to provide the magnitude marked 33 in the hardware modulus 41 in FIG. 5B. This is done by applying an offset signal 43 in FIG. 5B having a value equal to the modulus 41 minus the divisor 33. It is shown below that the offset is introduced to the adder 80 as part of the Do signal which includes the offset plus the Io signal (see FIG. 5C). The previous approach to generating the carry-out signal 35D as a function of Io and Do is limited by the integer values of the Io (FIG. 5D). The present invention, however, as discussed more completely later, resolves the problem by providing a fractional increment number for Io (FIG. 5C). From expression (2) above, the frequency of the output 27 should be a function of the ratio of the Increment (Io) and the divisor (Do-Io); therefore, the more different ratios which can be created, the more frequencies which can be generated and used. It follows that the greater the resolution of the Io 31 in FIGS. 5A, 5B, and 5C and the divisor 33 the greater the number of frequencies available from the oscillator 18.

When the modulus is exceeded an overflow occurs at 113 (i.e., the "1's" on the signal 35A . . . ) leaving a remainder, e.g., 37 or 39; whenever $$(\text{Increment} \times \text{some integer}) + \text{offset} \neq \text{modulus of adder} \quad (3)$$

there will occur successive carry-out signals 35D with unequal periods shown in FIG. 5D. As the period between specific number of clock periods (e.g., between 45A and 45B and between 45B and 45C) changes, these changes are seen as jitter, each with its own frequency components, which degrades the tones produced by the electronic musical instrument. In FIG. 5D, the total cycle of unequal clock periods is several periods for the signal 35D. For this reason, prior art use of similar circuitry has been limited to:

$$\text{Increment/Divisor} < 1/16 \quad (4)$$

and specifically where a Do of eight bits was used, an Io of no greater than four bits could have been used.

The present invention specifically overcomes this problem by increasing the resolution of the increment number (Io), by increasing the number of bits of Io without having Io approach Do in numerical value, so that the relationship of expression (4) above is maintained, and without increasing the number of bits of Do. This has been accomplished by the present invention by extending the number of bits of Io by four in a manner which represents the adder bits as having a value less than the least significant bit of the prior Io, that is, less than "1"; in other words, the lower four bits of Io conceptually are fractional bits. The fractional bits are generated by augmenting the Io input with bits less significant than the Do input to the adder 80, as now explained with reference to FIG. 7B.

Figure 7A:
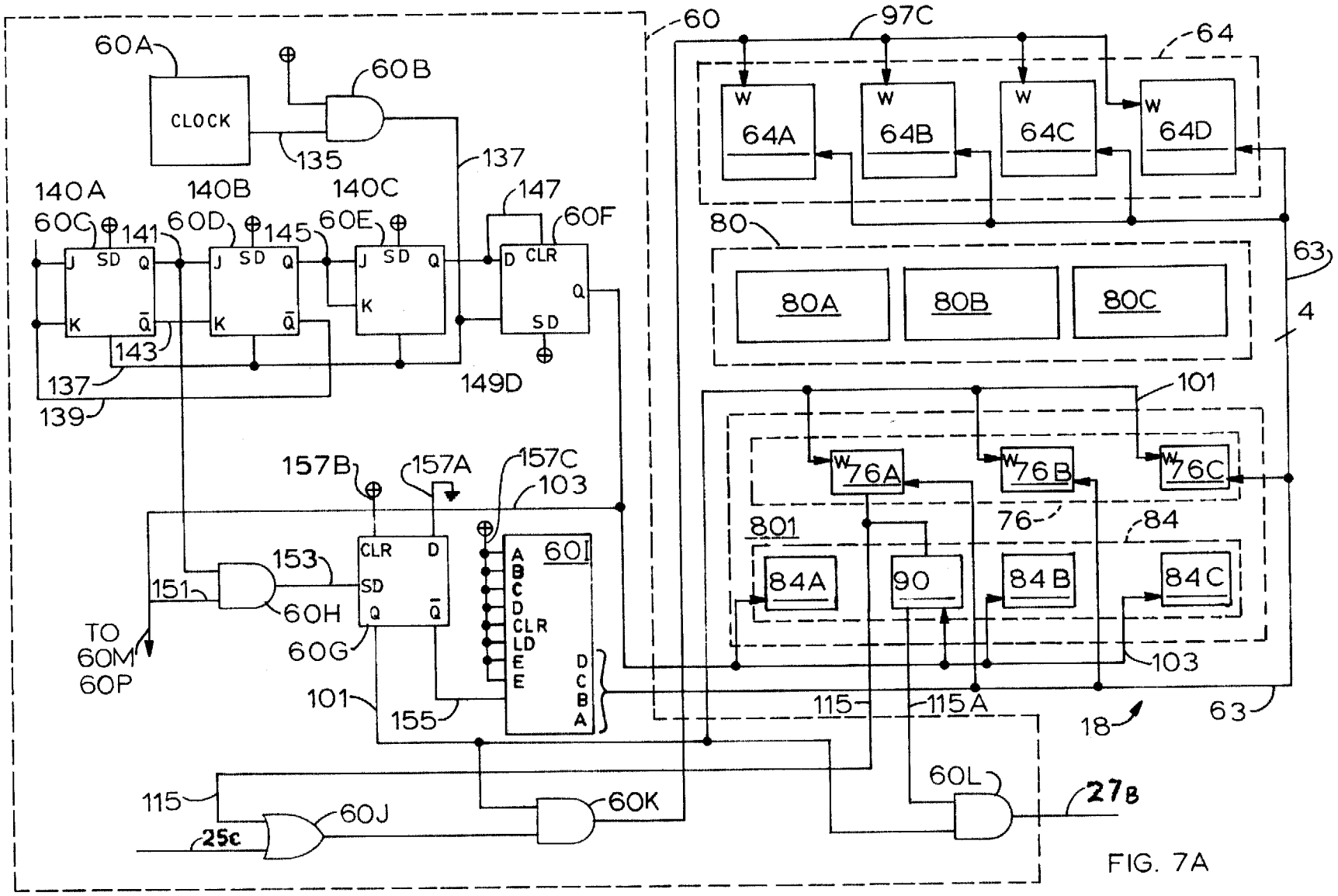
FIG. 7A is a schematic diagram showing the address and control logic of the oscillator of FIG. 4.
Figure 7B:
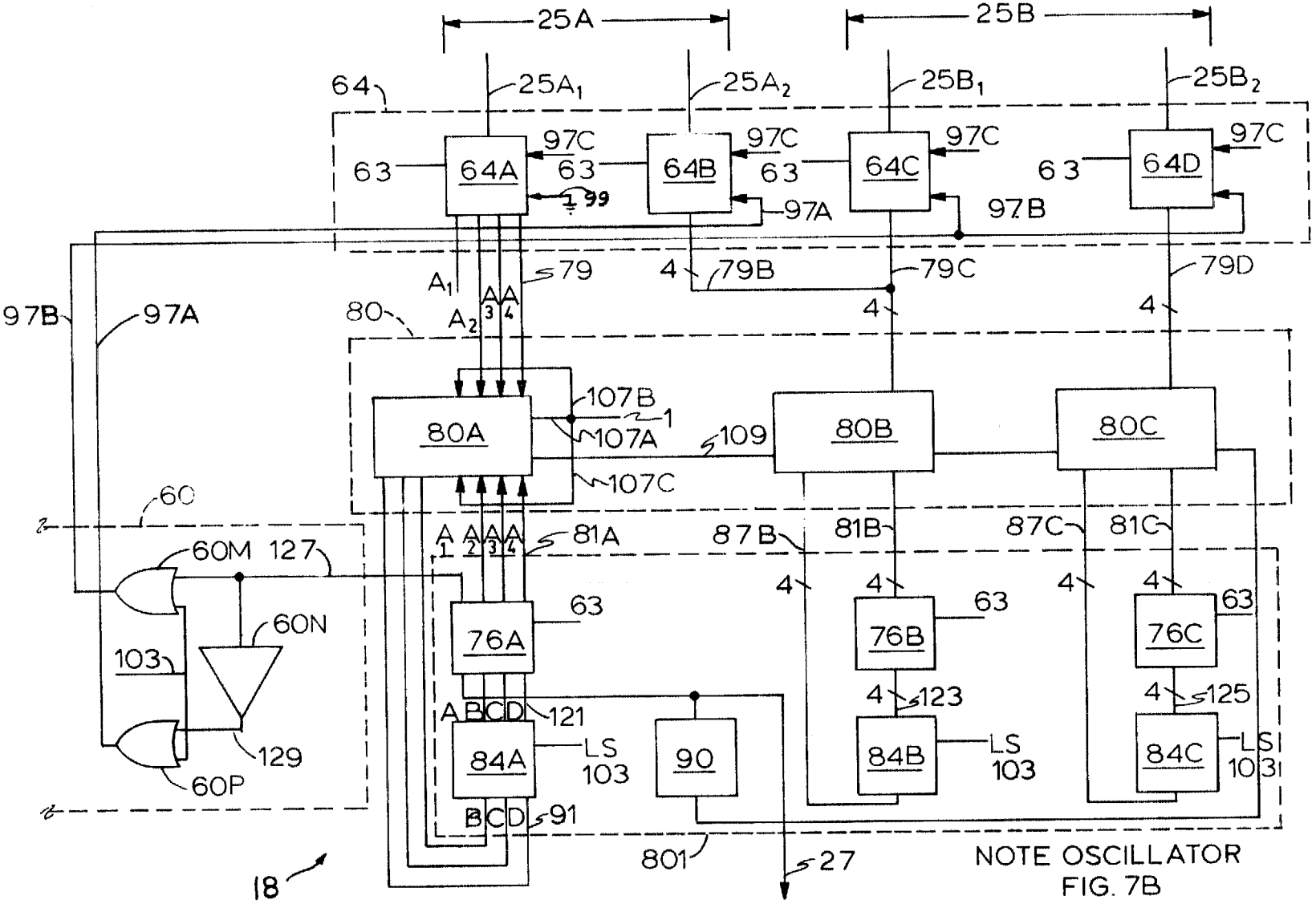
FIG. 7B is a schematic diagram showing the increment and modulus data flow of the oscillator of FIG. 4.

The oscillator 18 in FIGS. 7A and 7B is, in fact, the actual oscillator that has been fabricated by the present inventors. The adder 80 consists of adders 80A, 80B, and 80C. The register 64 consists of registers 64A, 64C, and 64D. The latch 84 consists of latches 84A, 84B, and 84C. The function of the register 74 in FIG. 4 is included in the register 76A. The input 25A in FIG. 4 consists, in FIG. 7B, of four bit inputs $\mathbf{25A_1}$ and $\mathbf{25A_2}$; the input 25B consists of four bit inputs $\mathbf{25B_1}$ and $\mathbf{25B_2}$. The clock logic 60 of FIG. 4 is shown in FIGS. 7A and 7B to contain a clock 60A, NAND-gates 60B, 60H, 60L, and 60K, J-K flip-flops 60C, 60D and 60E, D-type flip-flops 60F and 60G, a synchronous counter 60I, and NOR-gates 60J, 60M, 60N, and 60P.

Special note should be taken of the fact that the adder 80A has carry-in and adder inputs on leads 107A–107C connected to a logic "1" causing the minimal increment to be 1/16. Therefore the true relationship of Io in FIG. 7B is:

$$\text{Io} = (\text{increment} - 1/16) \quad (5)$$

and the value of Do is:

$$\text{Do} = (\text{Modulus of adder} - \text{Divisor}) + (\text{Increment} - 1/16) \quad (6)$$

To be consistent in the conceptual framework, the four bits introduced at $\mathbf{25A_1}$ in FIG. 7B have a value less than one, hence the adder 80 in FIG. 7B has a modulus of eight bits, or a maximum value of 256. Rewriting expression (6):

$$\text{Do} = (\mathbf{256} - \text{Divisor}) + (\text{Increment} - 1/16) \quad (7)$$

An example of calculating Io and Do will demonstrate the use of the above relationships. To have a frequency output of one-half the clock frequency, one can let:

Increment = 2; and

Divisor = 4 therefore, from expression (2) above, $$\text{Osc. Output Freq.} = \text{Clock Freq.} \times 2/4 \quad (8)$$

from expression (5) above, $$\begin{aligned} Io &= \text{Increment} - 1/16 \\ &= 2 - 1/16 = 1\ 15/16;\ \text{binary } 0001.1111 \end{aligned} \quad (9)$$

and from the expression (6) above, $$\begin{aligned} Do &= (256 - \text{Divisor}) + (2 - 1/16) \\ &= (256 - 4) + (1\ 15/16) \\ &= 253\ 15/16;\ \text{binary } 1111\ 1101.1111 \end{aligned} \quad (10)$$

It should be observed the Do (expression (10)) contains twelve bits of data, but only eight bits appear to be provided on leads $\mathbf{25B_1}$ and $\mathbf{25B_2}$ in FIG. 7B. Also it should be noted that the fractional, or lower four bits of Io and Do (expressions (9) and (10)) are identical; fortunately, the lower four bits will always be the same. It is therefore possible to reintroduce the lower four bits of Io received by the register 64A at $\mathbf{25A_1}$ and then by three of the four-wire leads 79A into the adder 80A during the same period that the Do signal on leads $\mathbf{25B_1}$ and $\mathbf{25B_2}$ are received by the adders 80B and 80C on four-wire leads 79C and 79D, respectively. This is accomplished by enabling the lower four bits of the Io register 64A by a continuous enable signal at 99. Thus there is no need to add to the bit length of Do.

One form of observing the superior performance of the present invention over the prior art is to observe how close the oscillator 18 comes (in frequency) to a desired predetermined set of closely spaced frequencies, in this case each having an equal ratio interval spacing of 1024 intervals to an octave, or a ratio of one note to the next adjacent note of 1024 $\sqrt{2:1}$. Table I below shows the prior art four bit Io and eight bit Do; Table II shows the preferred embodiment of the present invention having an eight bit fractional Io and an eight bit Do.

TABLE I

| DESIRED HZ. | INC. | DIV. | ACTUAL HZ. | ERROR HZ. | ERROR % |
|---|---|---|---|---|---|
| +261.6250 | 16 | 193 | +261.1398 | −.4851074 | −.1854208% |
| +261.8021 | 16 | 193 | +261.1398 | −.6622612 | −.2529627% |
| +261.9794 | 16 | 192 | +262.5000 | +.5205688 | +.1987059% |
| +262.1567 | 16 | 192 | +262.5000 | +.3431701 | +.1309026% |
| +262.3343 | 16 | 192 | +262.5000 | +.1656494 | +.0631444% |
| +262.5119 | 16 | 192 | +262.5000 | −.0119934 | −.0045687% |
| +262.6897 | 16 | 192 | +262.5000 | −.1897582 | −.0722366% |
| +262.8675 | 16 | 192 | +262.5000 | −.3673147 | −.1398478% |
| +263.0455 | 16 | 192 | +262.5000 | −.5455931 | −.2074139% |
| +263.2236 | 16 | 191 | +263.8743 | +.6506347 | +.2471794% |
| +263.4018 | 16 | 191 | +263.8743 | +.4724120 | +.1793502% |
| +263.5802 | 16 | 191 | +263.8743 | +.2940673 | +.1115665% |
| +263.7586 | 16 | 191 | +263.8743 | +.11560005 | +.0438281% |
| +263.9372 | 15 | 179 | +263.9664 | +.0291446 | +.0110421% |

TABLE II

| DESIRED HZ. | INC.(M) | DIV.(N) | ACTUAL HZ. | ERROR HZ. | ERROR % |
|---|---|---|---|---|---|
| +261.6250 | 12 6/16 | 149 | +261.6190 | −.0058899 | −.0022513% |
| +261.8021 | 15 10/16 | 188 | +261.8018 | −.0003052 | −.0001166% |
| +261.9794 | 10 9/16 | 127 | +261.9832 | +.0038147 | +.0014561% |
| +262.1567 | 15 13/16 | 190 | +262.1545 | −.0022278 | −.0008498% |
| +262.3343 | 16 | 192 | +262.5000 | +.1656494 | +.0631444% |
| +262.5119 | 16 | 192 | +262.5000 | −.0119934 | −.0045687% |
| +262.6897 | 15 15/16 | 191 | +262.8435 | +.1538085 | +.0585514% |
| +262.8675 | 9 15/16 | 179 | +262.8665 | −.0010071 | −.0003831% |
| +263.0455 | 14 15/16 | 119 | +263.0514 | +.0058594 | +.0022275% |
| +263.2236 | 15 2/16 | 181 | +263.2250 | +.0014343 | +.0005449% |
| +263.4018 | 12 2/16 | 145 | +263.4051 | +.0032349 | +.0012281% |
| +263.5803 | 10 2/16 | 121 | +263.5846 | +.0044250 | +.0016788% |
| +263.7586 | 13 1/16 | 156 | +263.7612 | +.0032654 | +.0012380% |
| +263.9372 | 15 4/16 | 182 | +263.9422 | +.0049744 | +.0018847% |

The general operation of the oscillator 18 in FIG. 7B is as follows. The Do signals at 25B$_1$ and 25B$_2$ and the Io signals at 25A$_1$ and 25A$_2$ are loaded into the Do registers 64C and 64D and the Io registers 64A and 64B, respectively. As long as the oscillator output at 27 does not indicate an overflow from the adder 80C, the enable logic at 60P will permit the Io to be received by the adders 80A and 80B on leads 79A and 79B when the register 64B is enabled by a signal at 97A. The other input to the adder 80C is received on four-wire leads 79D and the register 64D. The other adder inputs are received from the sum registers 76A, 76B, and 76C along four-wire leads 85, 83, and 81, respectively. The adder 80A carry-out is connected to the adder 80B carry-in along lead 109; and adder 80B carry-out is connected to adder 80C carry-in at 111. The adder 80C carry-out 113, after temporary storage in the latch 90, as above noted, is the oscillator 18 output on lead 27. The adder sum outputs appearing on leads 87A, 87B, and 87C are temporarily stored in the latches 84A, 84B, and 84C whose outputs are connected along leads 121, 123, and 125 to the registers 76A, 76B, and 76C; respectively. The outputs of the registers 76A, 76B, and 76C are connected to the adders 80A, 80B, and 80C along the leads 81A, 81B, and 81C, respectively. The transfers between the latches, registers, and adders are synchronized by clock pulses from the clock 60A, but offset in time, as required, by the write logic shown in FIGS. 7A and 6A, and discussed below. When the adder 80C has a carrt-out signal at 113, that signal, after being stored in the latch 90, is an input to the register 76A for use by clock logic 60M, 60N, and 60P. Thus, an output at 27 causes the Io register 64B to be disabled (by a signal at 97A) during the add period of the adders 80A, 80B, and 80C which, during this period, add the Do signal because the registers 64C and 64D are now enabled by clock logic 60N and 60P on lead 97B.

Figure 6A:
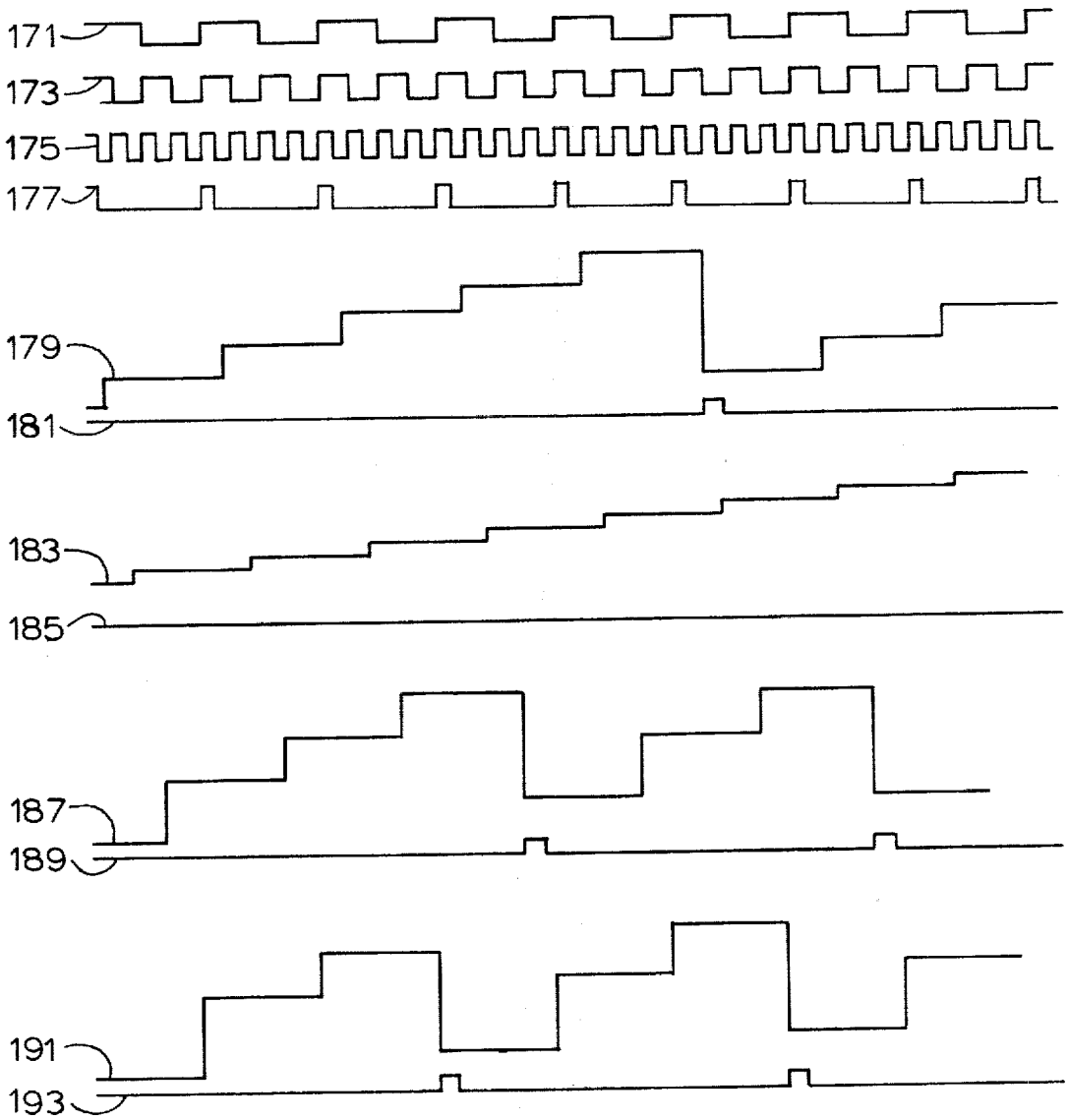
FIG. 6A is a timing and adder output graph of a four channel form of FIG. 4.

In FIG. 6A, the labels 171, 173, 175, and 177 represent binary control signals that are provided by the clock logic 60; labels 181, 185, 189, and 193 represent time-multiplexed output signals at the output 27; and 179, 183, 187, and 191 represent adder outputs at 87 (see FIG. 4) for time multiplexed oscillator operation. The signals 171 and 173 are address signals, 175 is a strobe signal and 177 is a clock period signal.

Figure 6B:
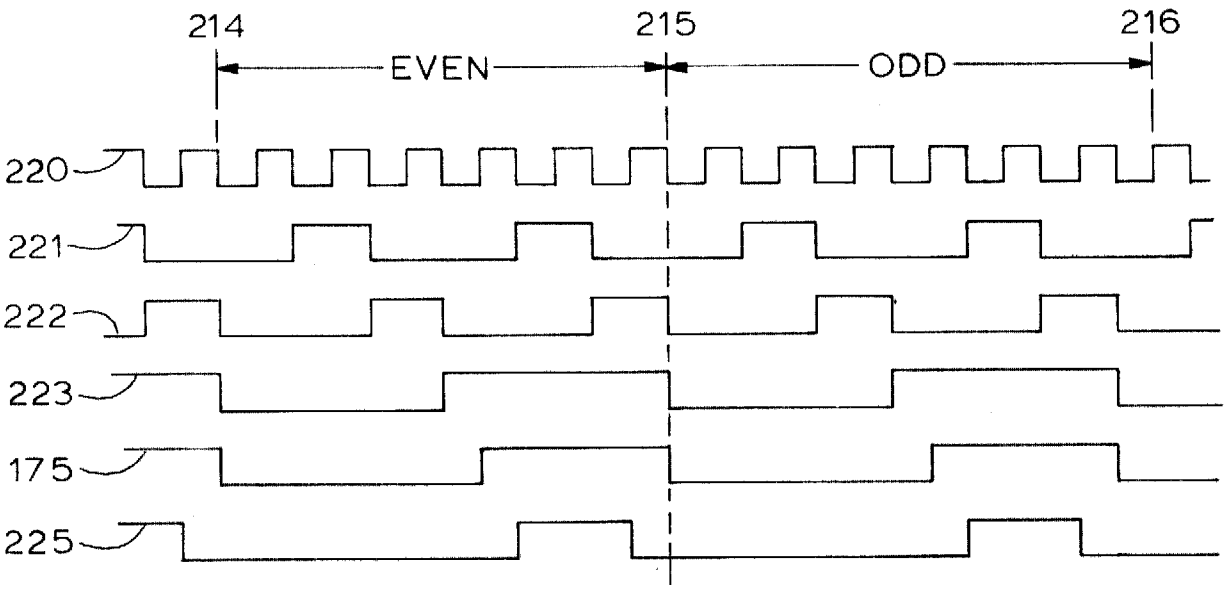
FIG. 6B is a timing diagram of the oscillator clock and internal control signals for the oscillator of FIG. 4.

Sequencing in the oscillator 18 is accomplished in accordance with the timing diagram of FIG. 6B wherein the designation 220 shows the time trace of the clock output at 135 in FIG. 7B, 221 shows the time trace of the output at 141 of the flip-flop 60C, 222 shows the time trace of the output at 145 of the flip-flop 60D, 223 shows the time trace of the output at 147 of the flip-flop 60E, 175 shows the time trace of the output at 103 (i.e., the strobe signal herein) of the flip-flop 60F, and 225 shows the time trace of the output at 97C of the NAND-gate 60K.

The preferred embodiment of the oscillator provides a plurality of frequency outputs by selectively addressing each of the Io registers 64A and 64B, the Do registers 64C and 64D, and the sum registers 76A, 76B, and 76C within each strobe signal cycle at 175. Each step of the above described adder outputs 179, 183, 187, and 191 (only four channels are given here but the instrument 251 has sixteen channels) and output signals 181, 185, 189, and 193 (again, only four of sixteen are described) of each of the plurality of the oscillator frequencies occurs independently of one another, but still are controlled by the clock logic 60 in FIG. 4. As seen in FIG. 6A, the strobe signal 175 in the present oscillator runs at a multiple above the single period signal 177 (i.e., the frequency of the strobe signal is higher than the frequency of the single period signal 177), where such multiple is the number of separate output frequencies, each sequentially addressed by incrementing the register address signals (here four output frequencies are given, but the actual instrument 251 has sixteen output frequencies, each having its own time channel) 171 and 173 within each single clock period so that the output 181 in FIG. 6A, having some predetermined frequency, is addressed when the address signals 171 and 173 are both high, and so forth, through four frequencies in the example but sixteen in the actual instrument 251. After the respective frequency information is enabled by the register address signals 171 and 173, the addition and sum are subsequently stored upon the occurrence of the strobe signal 175 which occurs at a rate four times the rate of the single period signal 177, in this example.

The oscillator multiplexing timing diagram shown in FIG. 6A has a single period 177 during which the oscillator registers, adders, and latches must complete all data movement for all channels during each step of the oscillator period. Because the oscillator 18 is intended to have more than one channel, or as many as can be permitted by the speed of the available digital hardware, there must be a timing signal at the period of the number of channels times the period of the single period frequency; this timing signal is the strobe signal 175 above. The function of the strobe signal 175 in FIGS. 6A and 6B, is to control the latches 84A, 84B, and 84C in FIG. 7A for the different channels within the larger period time interval 177 in FIG. 6A. A signal controlled by this strobe signal is applied along a lead 155 in FIG 7A, which is connected to the synchronous divider 601 to divide the strobe signal by the number channels (four in the example, but sixteen in the actual instrument 251). Thus, data movement within the oscillator 18 is initiated by the clock 60A once for each new address on four-wire leads 63 produced by the divider 60I. Within the oscillator 18, the different frequencies are produced by different Io and Do numbers which are all received by the oscillator hardware along the leads 25A and 25B in FIG. 7B. However, Io and Do signals are separately stored within the oscillator registers 64A, 64B, 64C, and 64D which have the necessary multiple storage locations to accept the Io and Do numbers paired according to the channel to which they refer. The same is true of the sum registers 76A, 76B, and 76C which receive the different sums indicative of the different frequencies, through the leads 87A, 87B, 87C, 121, 123, and 125; the sums are stored in multiple internal storage locations according to the register address applied when a particular sum is received. The latches 84A, 84B, 84C, and 90 have only one location per bit, and each transfers data to registers 76A, 76B, and 76C before the sum representative of the frequency assigned to the next channel is entered. The desired location within the multiple storage registers 76A, 76B, and 76C is accessed, or addressed, by the multi-lead register address conductors 63. In FIG. 6A, as above noted, the timing sequence is shown for an oscillator having four time channels each to accommodate a different address signal 173 and 171 sequence (i.e., the sequences 173 and 171 in FIG. 6A) through all four address states; the strobe signal 175 occurs four times. The first address signals 173 and 171 are "00", with the negative logic "0" representing a high; the output at 87 representing the first time-channel sum (i.e., the trace 179 in FIG. 6A) shows the increment (here, =2) being added upon the occurrence of the first strobe signal 175. The register address signals 173 and 171, now changes to "10", whereupon the output at 87 represents the second time channel (i.e., the trace 183 in FIG. 6A) which shows the addition of the increment (here, =1) upon the occurrence of the second strobe signal 175. Next, the signals 173 and 171 change to "01",whereupon the output at 87 represents the third time-channel (i.e., 187). However, during the prior period of this (third) time channel, an output (carry-out) was produced; therefore the modulus of the adder should now be adjusted by adding Do (here, =4), during the strobe signal. The final channel (in this example) to be enabled when the register address signals 173 and 171 are "11" to provide access to the fourth frequency within the registers 76A . . . and 64A . . . which are beginning another increment sequence and, therefore, have the range of the add modulus adjusted by adding (at the occurrence of the strobe signal 175) the fourth frequency Do (here, =5), i.e., the fourth trace 191 in FIG. 6A. Following this, another period 177 begins and the register address signals 173 and 171 return to "00" to access the first time channel.

The actual oscillator hardware, shown in 18 in FIG. 7B, operates in the identical manner to the above explanation, as above noted, but with sixteen channels instead of four and, therefore, has four register address signals on conductor 63 in FIG. 7A instead of the two signals 173 and 171 in FIG. 6A.

The frequency standard of the oscillator 18 in FIG. 7A is a crystal controlled clock 60A, which produces the clock signal 220 in FIG. 6B. The clock 60A is connected on the lead 135 to the NAND-gate 60B, which serves as a buffer/driver, and is thereafter connected on lead 138 to the J-K flip-flops 60C, 60D, and 60E and the D-type flip-flop 60F so that the timing sequence on Q0 output 141, the pulse sequence on 01 output at 145, the the pulse sequence Q2 output at 147 will be produced, providing the latch strobe signal 175 at 103, with a predetermined relationship to a clock signal on lead 137. The strobe signal at 103 in FIG. 7A is used to load the adder sum outputs at 87A, 87B, and 87C into the latches 84A, 84B, and 84C. The NAND-gate 60H combines the latch strobe signal at 103 and the first output signal 141 of the J-K flip-flop 60G, which provides a write signal on lead 101 to cause the registers 76A, 76B, and 76C to load the data from the latches 84A, 84B, and 84C as well as to provide timing of the input load write signals at 97C and the oscillator frequency output write signals at 163. The write signals at 163 are used to drive the octave dividers 190 discussed below. The flip-flop 60G also produces on lead 155 a complement of the write signal 101; the complement is used by the synchronous counter 60I to produce the register address signals on conductor 63 in a sequence similar to that shown by 171 and 173 in FIG. 6A. The new Io and Do numbers 25A and 25B in FIG. 7B, generated by the note calculator 16 in FIG. 1, are loaded into the respective registers 64A, 64B, 64C, and 64D on the occurrence of an output pulse at 27 from the oscillator 18 and the simultaneous occurrence of a low oscillator load signal at 25C in FIG. 7A from the note calculator 16 of FIG. 1. By this method, a new frequency within any time channel cannot be initiated until an output pulse of the prior frequency (of that channel) is produced, thus removing the occurrence of a transitional and unwanted output pulse on line 27.

The two data, Io and Do, which control the oscillator frequencies, as above stated, are applied at 25A and 25B, respectively, to the registers of 64A and 64B and 64C and 64D, respectively. Since these registers have sixteen locations for each of the four binary inputs $25A_1$, $25A_2$, $25B_1$, and $25B_2$ and are addressed by the register address lead 63 in FIG. 7A, each of the sixteen locations is the recipient of a different time channel and is capable of performing as a separate oscillator; therefore, the change or assignment of the frequency data Io and Do must be made relative to the proper register address on lead 63. This alignment of data with address code is provided elsewhere in the note calculator 16 in FIG. 1. The subsequent operation of the oscillator 18 in FIG. 7B occurs in a periodic sequence for all sixteen time channels, according to the register address on the lead 63 (which has sixteen possible values in the actual device—the four-channel device) and the simultaneous occurrence of the write signal on the lead 101 and the strobe signal on the lead 103.

For convenience and clarity, the operation of the oscillator 18 is now further explained in terms of one time channel. The carry-out 113 of the high order adder 80C in FIG. 7B carries the raw output frequency information, that is, the adder overflow, discussed earlier. When the carry-out occurs, it is temporarily stored by the high speed logic latch 90 and later transferred to the register 76A at the end of one period (a period is shown as the traces between 214 and 215 or between 215 and 216 in FIG. 6A) upon the occurrence of the latch strobe signal 175. During the next complete period 177 of that time channel, when the same register address appears on the conductor 63 in FIG. 7A, the carry-out stored in the register 76A will be available as a high level signal on the conductor 127 in FIG. 7B to disable at 97A the most significant four bits on the conductor $25A_2$ and to cause the Do register 64D at 97B to be enabled during the latch strobe signal at 103. The adders 80A, 80B, and 80C will add the Do signal together with the lower four bits of the Io signal from the registers 64C and 64D, as explained above, to the prior sum produced for that frequency during the prior period 177, now on the sum register output leads 81A, 81B, and 81C. Since the prior period 177 had an overflow, or carry-out at 27, the sum added will be the remainder of the prior addition. The Do signal from the registers 64C and 64D outputs are connected to the adders 80B and 80C over the register output leads 77 and 79. The adder outputs 87A, 87B, and 87C are connected to the inputs of the latches 84A, 84B, and 84C. The latches 84A, 84B, and 84C temporarily store the sum (before being stored in the registers 76C, 76B, and 76A) from the outputs of the adders 80C, 80B, and 80A. The latches 84A, 90, 84B, and 84C are connected to the registers 76A, 76B, and 76C on the leads 121, 123, and 125. The outputs of the registers 76A, 76B, and 76C are connected to the input of adders 80A, 80B, and 80C by the leads 81A, 81B, and 81C, respectively. When there is no indication of carry-out on the highest adder at 113, as occurs in the next period in this explanation, after the Do is added, the entire Io number registers 64A and 64B are enabled at 99 and 97A by the gate 60M (by a sum register signal at 127 being low and the simultaneous occurrence of the latch strobe signal at 103). The Io signals stored in registers 64A and 64B are received by the adders 80A and 80B along the leads 79A and 79B. The sharing of the leads 79B and 79C is permissible because of the open collector or tri-state outputs of the registers 64B and 64C; in the de-energized (zero) position, the leads 75 and 77 are pulled high, or in negative logic conventions, to provide a "0". The outputs of adders 80A, 80B, and 80C are stored in the latches 84A, 84B, and 84C and stored in the registers 76A, 76B, and 76C, respectively, before the onset of the next period 177. As long as the signal on the register output line 127 shows that the preceeding period had no oscillator output, or carry-out at 27, the next period will have the sum in the register incremented by Io; when the register output lead 127 shows a carry-out in the prior period, the divisor Do will be added.

Figure 8:
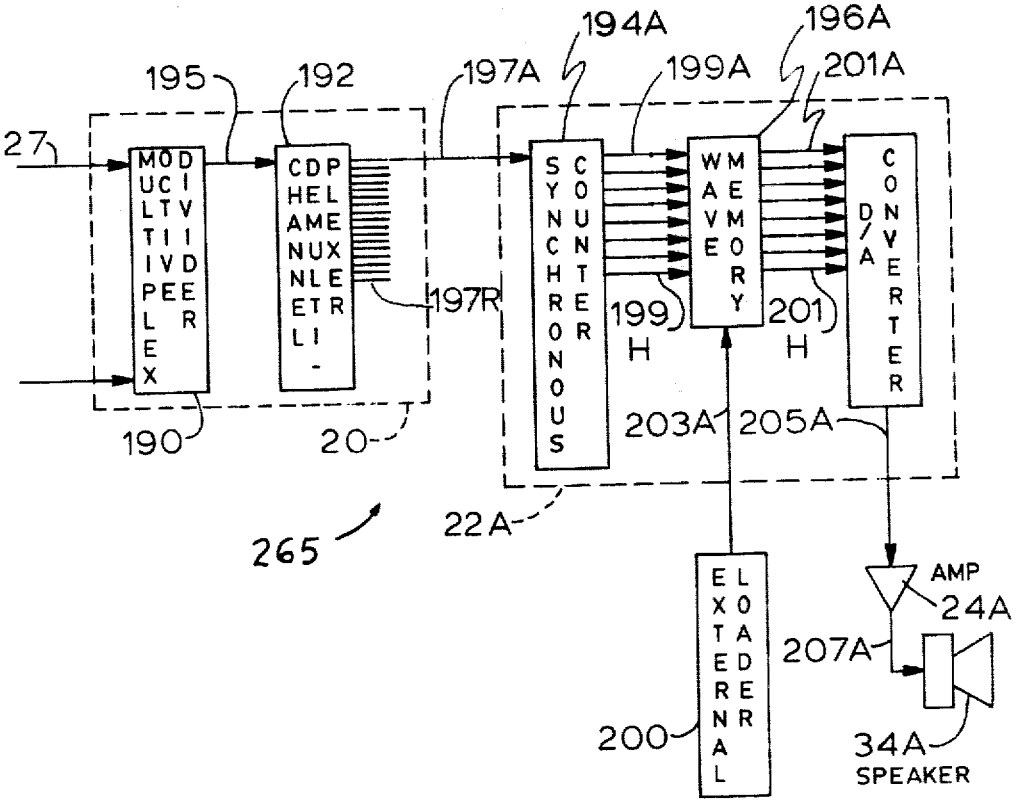
FIG. 8 is a block diagram of a wave generating system of the electronic musical instrument shown diagrammatically in FIG. 1.
Figure 9:
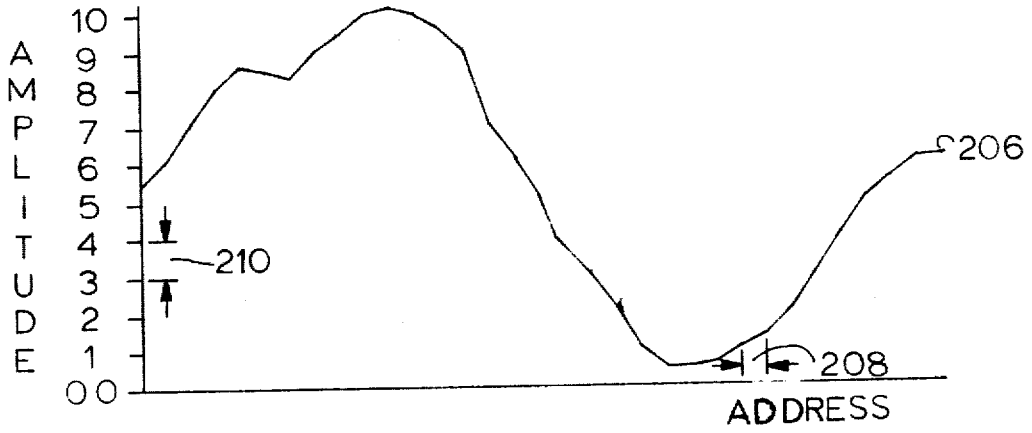
FIG. 9 shows a typical waveshape in the wave generating system of FIG. 8 showing sample points and amplitude output.

The oscillator 18 output lead at 27 is connected to the wave generating system shown at 265 in FIG. 1 and in more detail in FIG. 8. The wave generating system 265 produces up to a sixteen channel output when analog signals on conductors 205A to 205R in FIG. 1 are amplified and reproduced on a suitable amplifier 24A . . . and a corresponding speaker 34A . . . The alternate method of tone generation, mentioned earlier where the oscillator output pulses at 27 may themselves be conditioned (pulse shape modified, etc.) and filtered, may also be used here. However, because the oscillator 18 can produce a rate several times higher in frequency than the audible range, a more likely and versatile manner of producing a musical tone is in a manner similar to that shown in said U.S. Pat. No. 4,279,185 (Alonso, one one of the inventors herein), wherein the desired tone wave is reproduced from a reference waveform stored in a wave memory in a wave unit 22A. The stored waveform consists of a complete cycle, e.g., the waveform labeled 206 in FIG. 9 or a representative portion thereof. When the waveforms are irregular and nonsymmetrical, the entire period of the waveform is stored. When the musical instrument is played, the stored waveform is produced a portion of a cycle at a time. Specifically, the stored waveform is divided into a number of equal time intervals or segments 208 in FIG. 9. The time required to produce a complete cycle depends on the speed at which the segments 208 are stepped or sampled. The speed is directly related to the frequency of the desired tone. For each step 208, there is a specified wave amplitude shown at 210; typically, there may be sixty-four or one hundred and twenty-eight steps 208 per waveform 206. Each pulse of the oscillator at 27 is divided by a power of two by an octave divider 190 in FIG. 8; the power of two is specified by the note calculator 16 of FIG. 1. Here, the octave is the equivalent of a power of two change in oscillator output. The octave divider output at 195 is received by a channel demultiplexer 192 which provides independent oscillator outputs 197A–197R for each of the sixteen channels in the instrument 251. One channel of wave production is shown in connection with the wave unit 22A. The oscillator output at 27 is placed within the desired octave (by the octave divider 190) and connected to a channel of the wave unit 22A by a channel demultiplexer 192 along lead 197A. Within the wave unit 22A, the signal on the lead 197A is received by counter 194A which provides a binary number on leads 199A–199H; the binary number is incremented by steps of one. A wave memory 196A receives signals from the counter 194A along the leads 199A–199H. It is within the wave memory 196A that the waveform information (206 in FIG. 9) is stored. The amplitude outputs 210 of FIG. 9 appear on leads 201A–201H to be received by an D/A converter 198A. The D/A converter 198A provides an output which is subsequently amplified in the manner discussed earlier. New waveforms 206 may be introduced into the wave memory 196A by an external loader 200 connected to the wave memory at 203A.

Further modifications of the invention herein disclosed will occur to persons skilled in the art and all such modifications are deemed to be within the scope of the invention as defined by the appended claims.

What is claimed is:

1. A digital electronic musical instrument comprising, in combination:

means for selecting at least one desired note having a fundamental frequency, which means for selecting provides a binary output signal;

digital calculator means connected to receive the binary output signal and operable to produce, in binary form, values of a fractional increment number;

digital oscillator means comprising clock means for generating clock pulses at a predetermined periodic repetition rate, adder means having a first adder input and a second adder input respectively to receive a first binary input signal formed of binary bits having whole number significance and the fractional increment number, said adder means having a modulus, an adder sum output and a carry-out output, said adder means being operable to add the first binary input signal and, as a second binary input signal, the fractional increment number, said adder means being operable to provide a carry-out pulse on the carry-out output thereof whenever said modulus is exceeded, the fractional increment number being formed of binary bits, selected ones of which are aligned within the adder means to have a lower order of significance than the bits forming the first binary input signal, accumulator means having an accumulator input and an accumulator output, which accumulator means is connected to receive the clock pulses from the clock means and to receive the adder sum at the accumulator input and being operable to store the adder sum and to provide the stored adder sum at the accumulator output, said accumulator output being connected to provide said first binary input signal to said first adder input, so that an oscillator output is provided in the form of carry-out pulses having a rate proportional to said fractional increment number received by said second adder input; and means for producing said desired note in response to at least some of the carry-out pulses.

2. An instrument as claimed in claim 1 wherein the effect of the alignment of the binary bits forming the fractional increment number relative to the bits forming the first binary input signal is to provide a digital oscillator means modulus that is adjustable.

3. An instrument as claimed in claim 2 wherein said digital calculator means is operable to produce values of a divisor number, said divisor number being added periodically according to said clock pulses, wherein said divisor number is received by said second input of said adder means such that the modulus is effectively reduced by said divisor number upon said addition.

4. An instrument as claimed in claim 3 wherein said divisor number comprises a least significant bit and said fractional increment number also comprises a least significant bit, said least significant bit of said divisor number being more significant than said least significant bit of said fractional increment number.

5. An instrument as claimed in claim 3 wherein said divisor number comprises a least significant bit and said second adder input comprises a least significant bit, said divisor number being aligned to said second adder input such that said divisor number least significant bit is more significant than said least significant bit of said second adder input.

6. An instrument as claimed in claim 5 wherein said divisor number includes said fractional increment number.

7. An instrument as claimed in claim 6 further comprising input gating means having a gate control, a first gate input, a second gate input and a gate output, and wherein said first gate input is connected to receive said fractional increment number, said second gate input is connected to receive said divisor number, said gate output is connected to said second adder input, said gate control is connected to said adder carry-out such that the fractional increment number is received by said second adder input when there is no carry pulse and said divisor number is received by said second adder input on the occurrence of said carry pulse resulting in the addition of said divisor number and said first adder input signal, said adder sum output resulting from said addition being stored in said accumulator means on the occurrence of next said clock pulse.

8. An instrument as claimed in claim 7 wherein said divisor number includes bits of said fractional increment number having significance at least equal to said least significant bit of said divisor number, and said gating means enables said bits of said fractional increment number having significance less than said least significant bit of said divisor number during all operations of said adder.

9. An instrument as claimed in claim 8 further comprising storage means for storing said divisor number and said fractional increment number, and having inputs to receive said divisor number and said fractional increment number, outputs providing said divisor number and said fractional increment number to said second gate input and said first gate input respectively, a load input to load new signals, and to enable input connected to said carry-out output of said adder means so that the new signals are stored only immediately after the occurrence of said carry-out pulses.

10. An instrument as claimed in claim 9 wherein said accumulator means further comprises multiple storage locations and accumulator address input, and said oscillator further comprises accumulator address counter having a counter input and a counter output, and said oscillator comprises a output pulse selector having a selector input, a selector output, and selector address input, such that said clock means is connected to said counter input, said counter output connected to said selector address input and said accumulator address input, said selector input connected to said carry-out output and said selector output comprises multiple oscillator outputs wherein each oscillator output is aligned to a storage location according to a periodic address cycle provided by said counter, said oscillator providing time multiplexed independent outputs and said selector providing independent outputs when said fractional increment number and said divisor number comprise time multiplexed independent fractional increment and time multiplexed divisor numbers received by said second input according to said counter output.

11. An instrument as claimed in claim 10 wherein said storage means for storing said divisor number and said increment number comprise multiple storage locations and an address input, said storage means address input being connected to said counter output so that said storage means inputs receive multiple independent fractional increment numbers and independent divisor numbers and provide time multiplexed independent fractional increment numbers and time multiplexed divisor numbers received by said second input according to said counter output.

12. A digital oscillator comprising, in combination: clock means for generating pulses at a predetermined periodic repetition rate; adder means having a modulus and having a first adder input and a second adder input respectively to receive a first binary input signal formed of binary bits having whole number significance and, as a second binary input signal formed of binary bits, a fractional increment number, said adder means being operable to add periodically the first binary input signal and the fractional increment number, said adder means being operable to provide a carry-out pulse on a carry-out output thereof, in the course of the periodic additions, whenever the modulus of the adder means is exceeded, selected binary bits forming the fractional increment number being aligned within the adder means to have a lower order of significance than the bits forming the first binary input signal; accumulator means having an accumulator input and an accumulator output, which accumulator means is connected to receive the clock pulses from the clock means and to receive the adder sum at the accumulator input and being operable to store the adder sum and to provide the stored adder sum at the accumulator output, said accumulator output being connected to provide said first binary input signal to said first adder input, so that an oscillator output is provided in the form of carry-out pulses having a rate proportional to said fractional increment number received by said second adder input.

13. An oscillator as claimed in claim 12 wherein the effect of the alignment of the binary bits forming the fractional increment number relative to the bits forming the first binary input signal is to provide an adjustable modulus.

14. An oscillator as claimed in claim 12 wherein a divisor number is added periodically according to said clock pulses, wherein said divisor number is received by said second input of said adder means such that the modulus is effectively reduced by said divisor number upon said addition.

15. An oscillator as claimed in claim 14 wherein said divisor number comprises a least significant bit and said fractional increment number also comprises a least significant bit, said least significant bit of said divisor number being more significant than said least significant bit of said fractional increment number.

16. An oscillator as claimed in claim 14, wherein said divisor number comprises a least significant bit and said second adder input has a position that corresponds to a least significant bit position, said divisor number being aligned to said second adder input such that said divisor number least significant bit is more significant than the significance of the bit corresponding to said least significant bit position of said second adder input.

17. An oscillator as claimed in claim 16 wherein said divisor number includes said fractional increment number.

18. An oscillator as claimed in claim 17 further comprising input gating means having a gate control, a gate first input, a gate second input, and a gate output, and wherein said gate first input is connected to receive said fractional increment number, said gate second input is connected to receive said divisor number, said gate output is connected to said second adder input, and said gate control is connected to said adder carry-out output such that the fractional increment number is received by said second adder input when there is no carry-out pulse and said divisor number is received by said second adder input on the occurrence of said carry-out pulse resulting in the addition of said divisor number and said first adder input signal, said adder sum output resulting from said addition being stored in said accumulator means on the occurrence of next said clock pulse.

19. An oscillator as claimed in claim 18 wherein said divisor number includes bits of said fractional increment number having significance at least equal to said least significant bit of said divisor number, and wherein said gating means enables said bits of said fractional increment number having significance less than said least significant bit of said divisor number during all operations of said adder.

20. An oscillator as claimed in claim 19 further comprising storage means for storing said divisor number and said fractional increment number, and having inputs to receive said divisor number and said fractional increment number, outputs providing said divisor number and said fractional increment number to said second gate input and said first gate input respectively, a load input to load new signals, and an enable input connected to said carry-out output of said adder means so that the new signals are stored only immediately after the occurrence of said carry-out pulse.

21. An oscillator as claimed in claim 20 wherein said accumulator means further comprises multiple storage locations and accumulator address input, and said oscillator further comprises accumulator address counter having a counter input and a counter output, and said oscillator comprises an output pulse selector having a selector input, a selector output, and a selector address input, such that said clock means is connected to said counter input, said counter output connected to said selector address input and said accumulator address input, said selector input connected to said carry-out output and said selector output comprises multiple oscillator outputs wherein each oscillator output is aligned to a storage location according to a periodic address cycle provided by said counter, said oscillator providing time multiplexed independent outputs and said selector providing independent outputs when said fractional increment number and said divisor number comprises time multiplexed independent fractional increment numbers and time multiplexed divisor numbers received by said second input according to said counter output.

22. An oscillator as claimed in claim 21 wherein said storage means for storing said divisor number and said fractional increment number comprise multiple storage locations and an address input, said storage means address input being connected to said counter output so that said storage means inputs receive multiple independent fractional increment numbers and independent divisor numbers and provide time multiplexed independent fractional increment numbers and time multiplexed divisor numbers received by said second input according to said counter output.

* * * * *